US011248408B2

(12) United States Patent
Eisentraudt

(10) Patent No.: US 11,248,408 B2
(45) Date of Patent: Feb. 15, 2022

(54) WINDOW LIFT ASSEMBLY HAVING A SECURING ELEMENT AND A SECURING SECTION FOR SECURING A TRACTION MEANS

(71) Applicant: Brose Fahrzeugteile GmbH & Co. Kommanditgesellschaft, Bamberg, Bamberg (DE)

(72) Inventor: Michael Eisentraudt, Stockheim-Neukenroght (DE)

(73) Assignee: Brose Fahrzeugteile GmbH & Co. Kommanditgesellschaft, Bamberg, Bamberg (DE)

( * ) Notice: Subject to any disclaimer, the term of this patent is extended or adjusted under 35 U.S.C. 154(b) by 108 days.

(21) Appl. No.: 16/620,119

(22) PCT Filed: Jun. 4, 2018

(86) PCT No.: PCT/EP2018/064554
§ 371 (c)(1),
(2) Date: Dec. 6, 2019

(87) PCT Pub. No.: WO2018/224415
PCT Pub. Date: Dec. 13, 2018

(65) Prior Publication Data

US 2020/0102778 A1 Apr. 2, 2020

(30) Foreign Application Priority Data

Jun. 8, 2017 (DE) ..... 10 2017 209 719.1

(51) Int. Cl.
*E05F 11/48* (2006.01)
*E05F 15/689* (2015.01)

(52) U.S. Cl.
CPC ..... *E05F 11/486* (2013.01); *E05F 15/689* (2015.01); *E05Y 2201/66* (2013.01); *E05Y 2800/676* (2013.01); *E05Y 2900/55* (2013.01)

(58) Field of Classification Search
CPC ..... E05F 11/486; E05F 11/483; E05F 15/689
See application file for complete search history.

(56) References Cited

U.S. PATENT DOCUMENTS 5,333,411 A * 8/1994 Tschirschwitz ..... E05F 11/486 49/352
6,553,718 B2 * 4/2003 Arquevaux ..... E05F 11/485 49/352

(Continued)

FOREIGN PATENT DOCUMENTS

CA 2538433 A1 * 9/2006 ..... B60J 5/0416
CN 105370132 A 3/2016

(Continued)

*Primary Examiner* — Marcus Menezes
(74) *Attorney, Agent, or Firm* — Brooks Kushman, P.C.

(57) ABSTRACT

A window lift assembly for adjusting a window pane, including a carrier, a flexible traction means for transferring an adjusting force for adjusting the window pane and a deflecting piece, which is non-rotatably arranged on the carrier and has a guide channel for deflecting the traction means in a guide plane. To retain the traction means in the guide channel, at least one securing element on the carrier and at least one securing section are provided, the at least one securing element and the at least one securing section may be formed so that if sections of the traction means are displaced out of the guide channel toward the securing element and the traction means thus contacts the securing element, the securing section continues to block the traction means against a displacement transverse to the guide plane out of the guide channel.

19 Claims, 9 Drawing Sheets

(56) References Cited

U.S. PATENT DOCUMENTS

| | | | | |
|---|---|---|---|---|
| 7,958,676 | B2 * | 6/2011 | Kruger | E05F 11/483 49/352 |
| 10,526,832 | B2 * | 1/2020 | Gruca | E05D 15/165 |
| 2007/0169414 | A1 * | 7/2007 | Soerensen | E05F 15/619 49/325 |
| 2011/0126467 | A1 * | 6/2011 | Scharf | E05F 11/483 49/348 |
| 2015/0191957 | A1 * | 7/2015 | Takeda | E05F 11/483 49/352 |
| 2017/0089111 | A1 * | 3/2017 | Hazon | E05F 15/689 |
| 2018/0163455 | A1 * | 6/2018 | Gruca | E05F 11/483 |
| 2020/0181965 | A1 * | 6/2020 | Hong | E05F 11/483 |

FOREIGN PATENT DOCUMENTS

| | | | | | |
|---|---|---|---|---|---|
| DE | 102005041363 | A1 | | 3/2007 | |
| DE | 102005041636 | A1 | * | 3/2007 | E05F 11/483 |
| DE | 102005041636 | A1 | | 3/2007 | |
| DE | 60220548 | T2 | | 2/2008 | |
| DE | 202006014697 | U1 | | 2/2008 | |
| DE | 102008060182 | A1 | * | 6/2010 | E05F 11/483 |
| DE | 202015104588 | U1 | | 12/2016 | |
| DE | 102014019911 | B3 | * | 8/2019 | E05F 11/483 |
| EP | 0974478 | A1 | | 2/2005 | |
| EP | 1728957 | B1 | | 8/2010 | |
| EP | 3150756 | A1 | | 4/2017 | |
| JP | 5357870 | B2 | | 12/2013 | |
| JP | 6101449 | B2 | | 3/2017 | |
| WO | WO-2015198849 | A1 | * | 12/2015 | E05D 15/165 |
| WO | 2017036845 | A1 | | 3/2017 | |

* cited by examiner

WINDOW LIFT ASSEMBLY HAVING A SECURING ELEMENT AND A SECURING SECTION FOR SECURING A TRACTION MEANS

CROSS-REFERENCE TO RELATED APPLICATIONS

This application is the U.S. National Phase of PCT/EP2018/064554 filed Jun. 4, 2018, which claims priority to DE 10 2017 209 719.1 filed Jun. 8, 2017, the disclosures of which are hereby incorporated in their entirety by reference herein.

TECHNICAL FIELD

The present disclosure relates to a window lifter assembly for a window lifter provided for the adjustment of a window pane.

BACKGROUND

Window lifter assemblies for a window lifter provided for the adjustment of a window pane are widely known. Among other things, the same usually comprise a carrier, for example in the form of an assembly carrier for a vehicle door, and a flexible traction means, for example in the form of a Bowden cable, for the transmission of an adjusting force for the adjustment of the window pane. For the deflection of the traction means in a (cable) guide plane at least one deflection piece is non-rotatably arranged on the carrier. This usually rigid deflection piece includes a guide channel for the deflection of the traction means and defines the guide plane of the traction means by its course. In operation of the window lifter, the deflection piece arranged on the carrier hence deflects a traction means portion of the flexible traction means guided in the guide channel into a predetermined direction.

In the case of a window lifter for a vehicle, which is provided for lifting and lowering a window pane by means of the flexible traction means, the traction means usually is connected with an adjustment drive of the window lifter. A drive motor of this adjustment drive then for example rotates a cable drum slung with the flexible traction means in order to lift or lower the window pane, to which at least one driver connected to the traction means is attached, by rotating the cable drum in the one or other direction of rotation.

SUMMARY

For holding the traction means in the guide channel of the deflection piece a window lifter assembly according to one or more embodiments, may include at least one securing element on the carrier and at least one securing portion, e.g. on the deflection piece or carrier. The at least one deflection piece extends in a spatial direction that is substantially perpendicular to the guide plane of the traction means, and is disposed opposite the guide channel of the deflection piece. The at least one securing element faces a traction means portion of the traction means received in the guide channel and hence faces an open side of the guide channel. The at least one securing portion furthermore protrudes from an edge of the guide channel in a spatial direction that is substantially parallel to the guide plane of the traction means, wherein the at least one securing element and the at least one securing portion are configured and arranged relative to each other, in particular spaced apart from each other such that with a traction means portion displaced out of the guide channel in the direction of the securing element and a resulting abutment of the traction means against the securing element the securing portion still blocks the traction means against a displacement transversely to the guide plane out of the guide channel.

The at least one carrier-side securing element and the at least one securing portion on the guide channel of the deflection piece thus ensure in combination that the traction means with the traction means portion guided in the guide channel in any case remains in the guide channel and cannot undesirably be displaced out of the same. In particular in the case of a slack in a traction means configured as a Bowden cable it can hence be ensured that the traction means is secured against a removal from the guide channel. In a state of relief of the flexible traction means, in which in contrast to an operation of the window lifter the traction means is not yet or no longer tightly tensioned, it may abut against the securing element of the carrier due to its inherent rigidity. In particular the relative position of the securing element with respect to the securing portion, however, according to one or more embodiments, may be adjusted such that with such an abutment and the resulting displacement of a traction means portion with respect to the guide channel possible transverse forces on the traction means may still be supported by the securing portion, and the traction means hence is secured against slipping out or jumping out of the guide channel.

Due to the cooperation between the carrier-side securing element and the securing portion, both the securing element and the securing portion may have a more compact design and be formed by using a comparatively small amount of material. This is advantageous in particular with a view to the deflection piece, which with a view to low wear, compressive strength and high-temperature resistance may be made of a comparatively expensive high-performance plastic with very good tribological properties. When the deflection piece possibly may be formed with the securing portion provided thereon by using a small amount of material without deteriorating the securing function for the traction means, cost advantages may be achieved, as ultimately a smaller amount of the more expensive high-performance plastic, e.g. a polyaryl ether plastic, in particular polyether ether ketone (PEEK) has to be used.

In one design variant the at least one securing element and the at least one securing portion are adjusted to each other and to the traction means, in particular to its diameter, such that via the at least one securing element and the at least one securing portion the flexible traction means is prevented from being displaced out of the guide channel both parallel to the guide plane and transversely thereto. The at least one securing element of the carrier precludes a displacement out of the guide channel above all parallel to the guide plane, while the edge-side securing portion precludes the displacement out of the guide channel transversely to the guide plane and hence supports possible transverse forces on the traction means.

Between the at least one securing element of the carrier and the deflection piece a gap may be present, through which the flexible traction means (properly arranged already on the carrier and installed) extends in a relaxed state of relief that is different from a tensioned or tautened state of the traction means which exists in operation of the window lifter. In the relaxed state of relief a traction means portion of the traction means hence is held in the gap by the at least one securing element, and hence is still securely held in the guide channel by the at least one securing element in combination with the at least one securing portion. In this design variant the at least one securing element and the at least one securing portion thus ensure that also in a relaxed state of relief, in which e.g. the window lifter is not (yet) in operation, the traction means is secured against a removal from the guide channel. Hence, even with a slack in the traction means it is ensured that the traction means securely remains on the deflection piece.

In one design variant, the gap present between the at least one securing element and the deflection piece may have a width that maximally corresponds to three times a mean diameter of the traction means and at least to the mean diameter of the traction means. In particular, the width of the gap may lie in a range of 1D to 1.5D, in particular of 1D to 1.3D or of 1.1D to 1.4D with a mean diameter D of the traction means. The gap thus is dimensioned in its width such that the traction means may be inserted therein and a traction means portion as such may be removed from the gap transversely to the guide plane. Due to the interaction of the securing element and the securing portion, however, such a larger gap, i.e. a gap whose width at least corresponds to the diameter of the traction means, may be permitted without thereby running a risk that the traction means slips down from or jumps out of the deflection piece. The width of the gap rather may at least correspond to the diameter of the traction means, whereby mounting the same on the carrier and on the deflection piece is facilitated.

In an exemplary embodiment the guide channel has a varying depth along its extension. The guide channel depth varies e.g. with respect to a mean diameter D of the traction means between 3D and 1D or is even smaller than D. In one variant, the depth of the guide channel in at least one portion is less than a mean diameter of the traction means guided therein or of the traction means portion supplied therein. In at least one further portion bordered by the at least one securing portion the depth of the guide channel furthermore is greater than a mean diameter of the traction means guided therein. The guide channel then may have a depth that is less than a mean diameter of the traction means over at least half of its extension. Thus, a traction means portion guided in the guide channel at least slightly projects from a large part of the guide channel.

In an exemplary embodiment, the guide channel has an arc-shaped, in particular circular arc-shaped extension. The deflection piece that forms the guide channel also may be designed arc-shaped itself.

In one design variant the at least one securing element of the carrier is offset with respect to the at least one securing portion, based on a direction of extension of the guide channel. The securing element and the securing portion thus do not directly face each other. In one variant of the window lifter assembly at least two securing elements are provided on the carrier, which are spaced apart from each other and face different regions of the guide channel.

In one design variant at least one securing portion is provided on the deflection piece.

In a possible development at least two securing portions spaced apart from each other and bordering different regions of the guide channel may also be provided on the deflection piece. For example, one securing portion and one securing element each are assigned to one of two ends of the guide channel so that to each end of the guide channel a pair consisting of securing element and securing portion is assigned.

Alternatively or in addition, at least one securing portion bordering the guide channel may likewise be provided on the carrier, in particular be integrated therein or be attached as a separate component. This in particular includes a variant in which at least one carrier-side securing element is combined with a securing portion on the deflection piece and at least one further securing portion on the carrier. In a securing portion that is formed by a (securing) component separately attached to the carrier and different from the deflection piece, this component in a development may serve the fixation of the deflection piece on the carrier when the deflection piece likewise is formed as a separate component. The additionally provided (securing) component for example may be screwed to the carrier, clipped into or onto the same, be hot-caulked or welded to the carrier, in particular be fixed by ultrasonic welding.

In principle, the deflection piece may be formed as a separate component and be fixed to the carrier. This is recommendable in particular when manufacturing the deflection piece and the carrier from different materials. The deflection piece may be made of a material with very good tribological properties, such as for example a polyaryl ether plastic, in particular PEEK, whereas the carrier, for example an assembly carrier or a guide rail, is made of a less expensive metal and/or plastic material.

For the fixation of the deflection piece on the carrier a plurality of form-fit regions may be provided on the carrier. Such a form-fit region for the positive connection between deflection piece and carrier for example may include a groove, an opening or a—for example pocket-shaped-depression. Into such a form-fit region a form-fit element of the deflection piece may be inserted during mounting of the window lifter assembly in order to fix the deflection piece on the carrier.

In an exemplary embodiment the deflection piece may include at least three form-fit elements for the positive connection with the carrier. For example, at least two end-side form-fit elements each are provided in the region of an end of the guide channel. At least one further (third) form-fit element then is provided along the guide channel between the end-side form-fit elements. In a development based thereon, which may include an arc-shaped deflection piece that extends along a circular arc, the at least one (middle) form-fit element provided between the end-side form-fit elements is formed on the deflection piece so as to project radially inwardly with respect to this circular arc. The middle form-fit element thus has e.g. a kind of nose or web for insertion into a form-fit region, for example a groove, on the carrier. By providing three form-fit elements, the deflection piece furthermore in principle may comparatively easily and non-rotatably be fixed to the carrier. The alignment of the deflection piece with respect to the carrier also is clearly defined so that incorrect mounting is almost excluded.

In an alternative design variant the separately manufactured deflection piece is at least partly embedded into the material of the carrier. Here, a fixation of the deflection piece on the carrier consequently is effected by insertion into the material of the carrier or by at least partly overmolding the deflection piece. For example, a deflection piece is inserted directly during the manufacture of the carrier and overmolded so that no subsequent mounting operation is required and a firm, clearance-free fit of the deflection piece on the carrier is ensured.

In an exemplary embodiment the deflection piece is formed symmetrically to an axis extending parallel to the guide plane so that the deflection piece rotated by 180° about this axis may also be properly mounted on the carrier. The axis (of symmetry) here in particular may extend transversely to the direction of extension of the guide channel. The symmetrical design of the deflection piece here in particular includes the symmetrical formation and arrangement of form-fit elements of the deflection piece, which are provided on the deflection piece, in particular formed thereon, for the positive connection with the carrier. Due to the symmetrical formation of the deflection piece, the same may be mounted at different positions of the carrier, for example at an upper and a lower end of a guide rail. For the different deflection points on the carrier, identically formed deflection pieces thus may be used.

In principle, with a window lifter assembly according to one or more embodiments, there may be provided a window lifter for adjusting a window pane in a vehicle, in particular a motor vehicle, as well as a door module for a vehicle door in which a window pane to be adjusted by the window lifter in the closed condition closes a window opening in the vehicle door.

The attached Figures by way of example illustrate possible design variants of the proposed solution.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

From DE 10 2005 041 363 A1, a known window lifter assembly with a rigid deflection piece that is fixed to a carrier as a separate component. The deflection piece here may be transferred from a mounting position into a functional position on the carrier, wherein on transfer into the functional position a flexible traction means already guided on the deflection piece is tautened.

Figure 7:
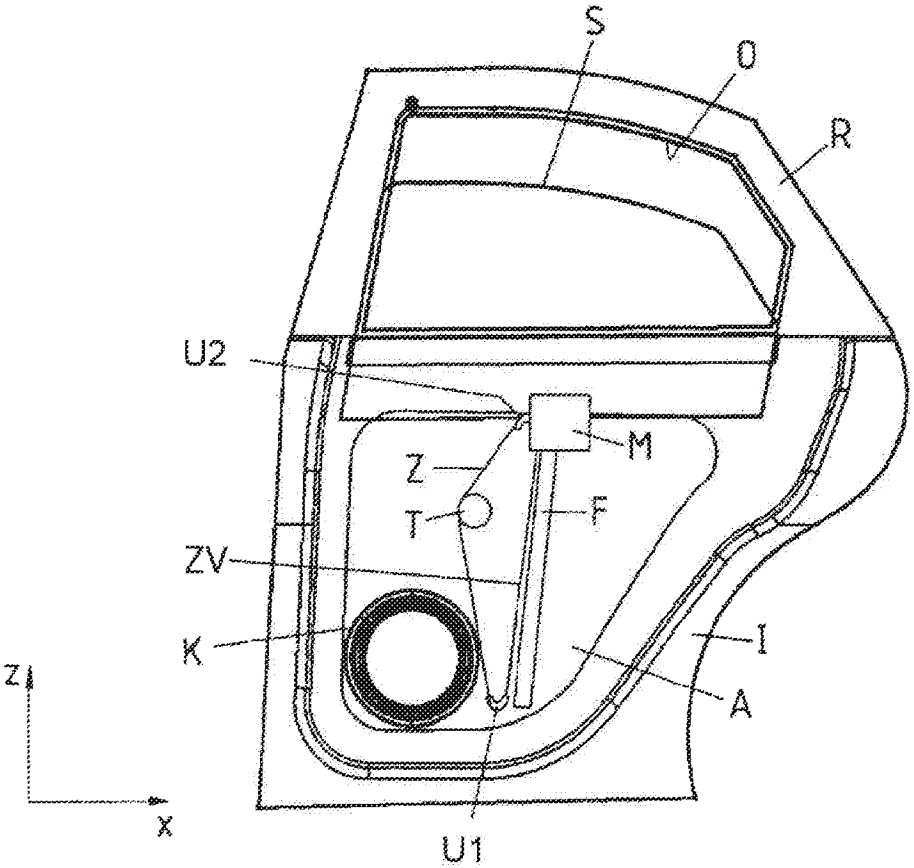
FIG. 7 shows a schematic representation of a motor vehicle door with a window lifter.

FIG. 7 schematically shows a motor vehicle door that may include a window frame R enclosing a window opening O and a door inner skin I arranged below the window opening O and the window frame R. The door inner skin I includes a large-surface cutout that is covered by a carrier in the form of an assembly carrier A. On this assembly carrier A window lifter and further door components K, such as a loudspeaker, are mounted. Before arranging the assembly carrier A on the door inner skin I, the window lifter and the individual door components K may be premounted on the same and be functionally pretested, before the assembly carrier A is attached to the door inner skin I as a completely prefabricated and pretested door module. The assembly carrier A usually is made of plastics, but may also be made of metal.

The window lifter mounted on the assembly carrier A may include an adjustment drive, which for example may be driven by a motor or manually by a crank and which serves to generate a rotary movement of a cable drum T about an axis of rotation. A longitudinally extended, flexible traction means in the form of a Bowden cable Z here is slung around the cable drum T. During a rotation of the cable drum T the Bowden cable Z is moved in the one or other direction along its longitudinal extension—depending on the direction of rotation. The flexible Bowden cable Z is deflected on the assembly carrier A by two (lower and upper) deflection elements U1, U2 such that an adjustment portion ZV of the Bowden cable Z extends parallel to a guide rail F on the assembly carrier A. On this guide rail F a driver M is longitudinally shiftably mounted, which on the one hand (for example via a cable nipple) is connected to the Bowden cable Z and which on the other hand carries a window pane S to be adjusted. By means of the window pane S the window opening O defined by the window frame R may be closed. In operation of the window lifter, i.e. during a rotary movement of the cable drum T, the adjustment portion ZV is moved along the guide rail F so that the driver M connected to the adjustment portion ZV of the Bowden cable Z is lifted or lowered along the guide rail F and thereby entrains the window pane S connected to the driver M.

Figure 1A:
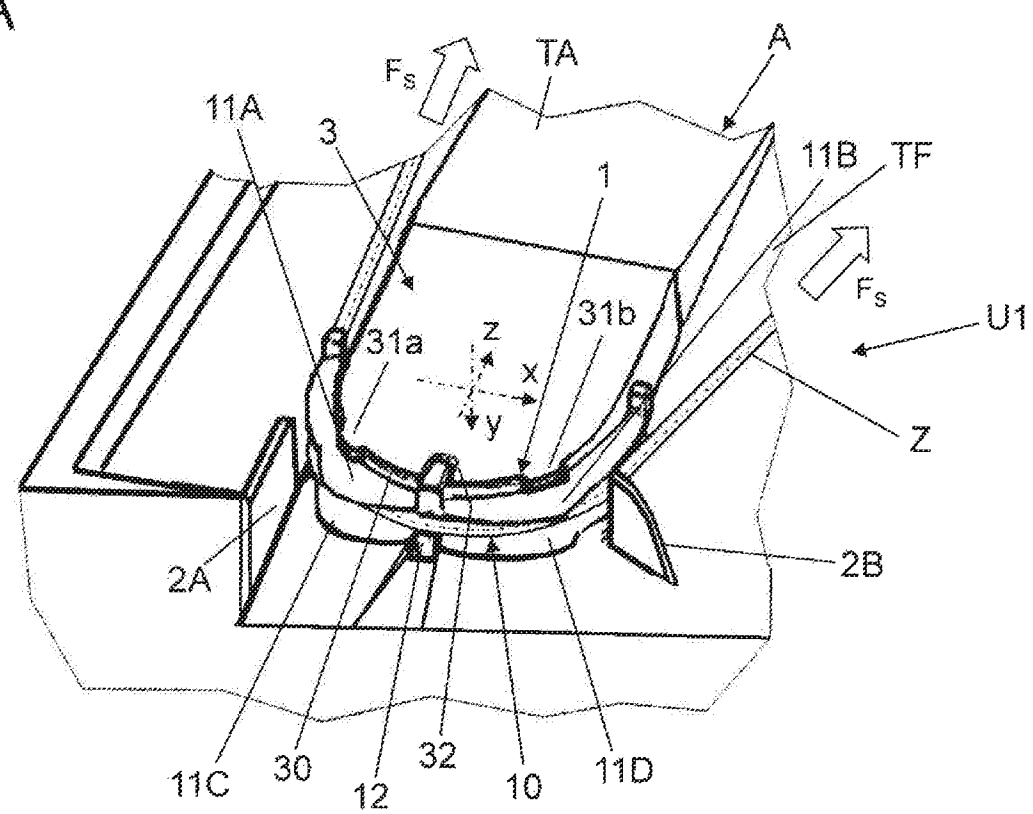
FIGS. 1A-1B sectionally show a design variant of a window lifter assembly according to one or more embodiments, with a traction means in the form of a Bowden cable deflected on a deflection piece in a tautened and hence tensioned operating condition (FIG. 1A) and in a non-tensioned state of relief (FIG. 1B)
Figure 1B:
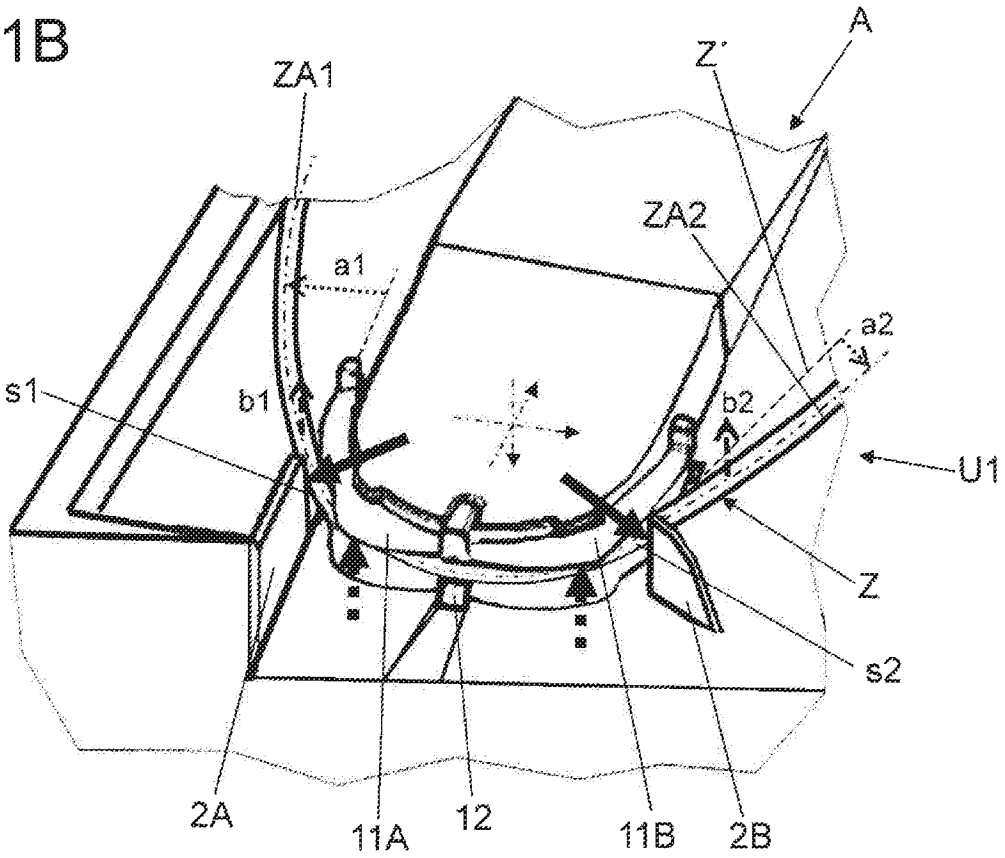

FIGS. 1A and 1B sectionally show the window lifter of FIG. 7 with a view to one of the deflection elements U1, U2, here the lower deflection element U1. This deflection element U1 is defined by a deflection piece 1 non-rotatably fixed to the assembly carrier A. The deflection piece 1 has an arc-shaped extension and forms an arc-shaped guide channel 10 in order to deflect the Bowden cable Z guided therein into a predetermined direction. The deflection piece 1 is arranged on a fastening portion 3 of the assembly carrier A. This fastening portion forms a rounded, convexly curved end of a carrier portion TA of the assembly carrier A protruding from a carrier surface TF of the assembly carrier A.

FIG. 1A shows the Bowden cable Z in a tautened and tensioned condition when the window lifter is properly mounted and in operation. Here, a cable force $F_s$ acts on the Bowden cable Z, which pulls the Bowden cable Z extending in a cable guide plane (xz-plane) into the guide channel 10 of the deflection piece 1.

In a relaxed state of relief of the Bowden cable Z as shown in FIG. 1B, the Bowden cable Z no longer is quite taut and the abutment of the Bowden cable Z against the deflection piece 1 also is less tight as compared to the operating condition of FIG. 1A. The relaxed condition of the Bowden cable Z shown in FIG. 1B may occur above all during the assembly of the window lifter or be obtained in principle when there is a slack in the Bowden cable Z. As compared to the tensioned condition, which is shown in FIG. 1B by a broken line and is designated with Z', Bowden cable portions ZA1 and ZA1 extending away from the deflection piece 1 have moved away from the carrier portion TA due to the inherent rigidity of the Bowden cable Z. They have a larger lateral distance a1, a2 to the carrier portion TA. In particular in the case of possible vibrations, there is then an increased risk that the Bowden cable Z undesirably slips out or jumps out of the guide channel 10 of the deflection piece 1. On the one hand, one risk is a downward displacement of the Bowden cable Z in the cable guide plane so that the Bowden cable Z is displaced out of the guide channel 10 in a spatial direction −z. On the other hand, transverse forces may act in a spatial direction −y transversely to the cable guide plane, which in principle likewise may lead to a displacement of the Bowden cable Z out of the guide channel 10. In the illustrated design variant, however, both risks are considerably reduced or entirely avoided with a comparatively low amount of material and a still given easy and fast mountability of the window lifter assembly by means of the carrier-side securing elements 2A, 2B and the securing portions 11A, 11B provided on the deflection piece 1.

The securing portions of the assembly carrier A are designed as securing webs 2A, 2B. These securing webs 2A, 2B each protrude from the carrier surface TF in the spatial direction −y and hence transversely to the cable guide plane (xz-plane) and face the guide channel 10 of the deflection piece 1 mounted on the assembly carrier A. Each securing web 2A, 2B is assigned to an end of the guide channel 10 and prevents a displacement of a Bowden cable portion ZA1 or ZA2 extending away from the guide channel 10 transversely to the longitudinal extension of the Bowden cable Z by more than a permitted extent. Correspondingly, in the relaxed condition of the Bowden cable Z as shown in FIG. 1B the Bowden cable portions ZA1 and ZA2 each rest against one of the securing webs 2A, 2B. When a Bowden cable portion ZA1 or ZA2 rests against the securing web 2A or 2B, this Bowden cable portion ZA1, ZA2 extends through a gap s1 or s2 that is present between the deflection piece 1 and a carrier-side securing web 2A or 2B. Each Bowden cable portion ZA1 or ZA2 thus may move away from the deflection piece 1 in the cable guide plane, but only until it abuts against the respective securing web 2A or 2B and hence remains in the defined gap s1 or s2.

For additionally securing the traction cable Z on the guide channel 10 the securing portions formed as securing tabs 11A, 11B are provided on the deflection piece 1. These securing tabs 11A and 11B each border the guide channel 10 and protrude in the spatial direction −z and hence transversely to the direction of longitudinal extension of the Bowden cable portion guided in the guide channel 10, but substantially parallel to the cable guide plane. Each securing tab 11A, 11B thereby supports the Bowden cable portion guided in the guide channel 10 in the case of occurring transverse forces and prevents the Bowden cable from slipping out of the guide channel 10 of the deflection piece 1 as a result of a deflection b1 or b2 transversely to the cable guide plane, which is shown in FIG. 1B. To hold the Bowden cable Z on the guide channel 10 also in the relaxed condition of the Bowden cable Z, the securing webs 2A and 2B thus support the Bowden cable Z in the cable guide plane and the securing tabs 11A and 11B of the deflection piece 1 support the Bowden cable Z transversely to the cable guide plane.

The carrier-side securing webs 2A and 2B and the securing tabs 11A and 11B of the deflection piece 1 here are adjusted to each other and to the diameter of the Bowden cable Z and arranged relative to each other such that even with traction means portions ZA1 and ZA2 displaced out of the guide channel 10 in the direction of the securing webs 2A, 2B and a resulting abutment of the traction means Z against the securing webs 2A and 2B the securing tabs 11A and 11B of the deflection piece 1 still block the traction means Z against a displacement transversely to the cable guide plane out of the guide channel 10. The traction means portions ZA1 and ZA2 are held in the respective gap s1 or s2 and also in the guide channel 10. The width of the gap s1, s2 between a securing web 2A or 2B and the deflection piece 1 may be greater than the diameter of the Bowden cable Z, whereby the insertion of the Bowden cable Z into the guide channel 10 is facilitated during the assembly. The protruding securing tabs 11A and 11B need not protrude excessively and in particular need not locally deepen the guide channel 10 by a multiple of the diameter of the Bowden cable Z, which with regard to a manufacture of the deflection piece 1 from a comparatively expensive material, such as PEEK, involves cost advantages. Especially the combination of carrier-side securing webs 2A, 2B and securing tabs 11A, 11B bordering and locally deepening the guide channel on the deflection piece 1 provides for securely holding the Bowden cable Z on the guide channel (in particular in the non-tensioned condition of the Bowden cable Z) with a good mountability of the Bowden cable Z and comparatively low costs at the same time. In this connection, the simple tool technology when manufacturing the guide channel without slide and without tool separation also is advantageous. In the contact area with the Bowden cable Z no separation lines (separation burrs) or also shoulders (edges) are present, which in operation of the window lifter might lead to noises.

Figure 2:
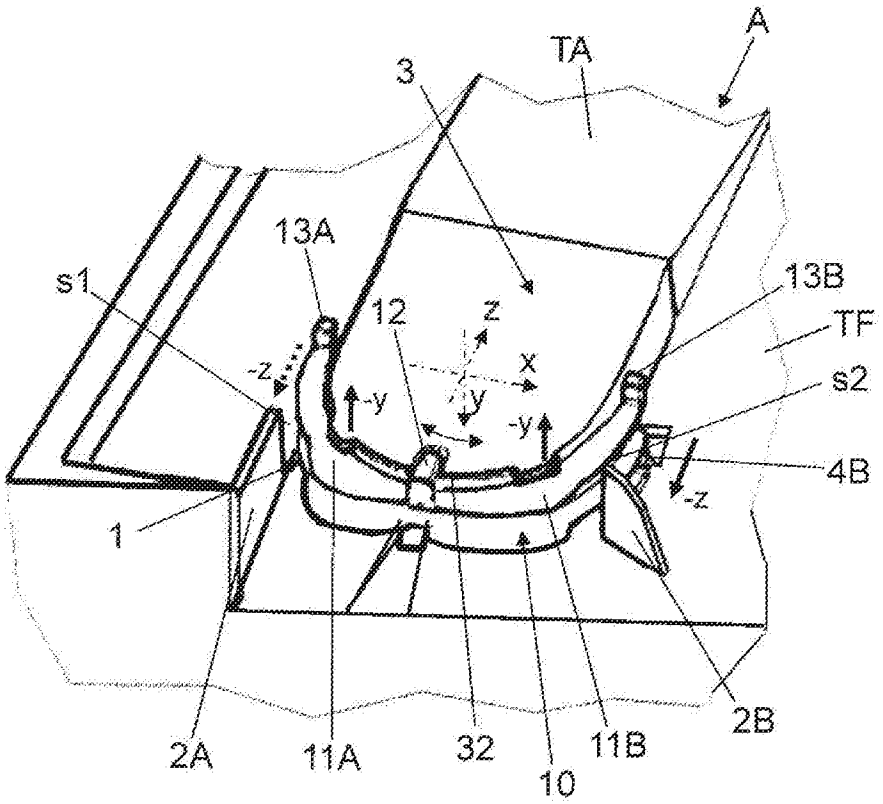
FIG. 2 in a view corresponding with FIGS. 1A and 1B shows the window lifter assembly without the traction means.
Figure 3A:
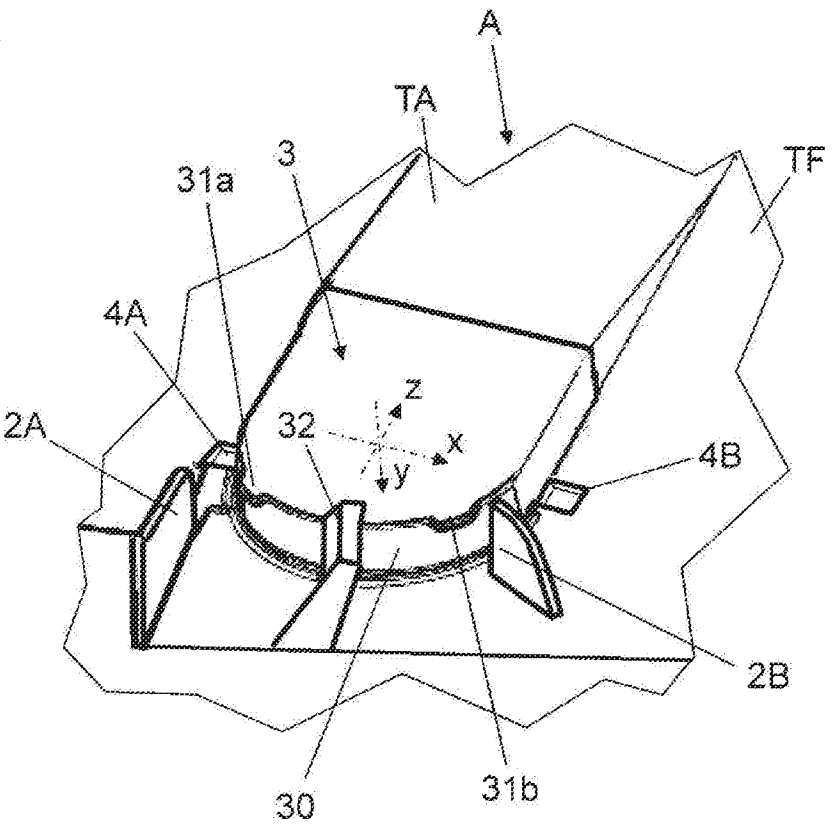
FIG. 3A shows a carrier of the window lifter assembly of FIGS. 1A to 1B and 2 without the deflection piece.
Figure 3B:
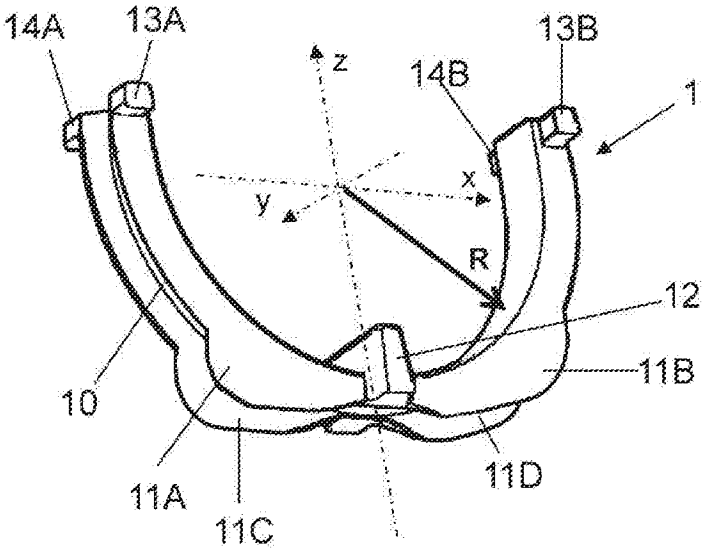
FIG. 3B shows the deflection piece of the window lifter assembly individually and in a perspective view.

The circular arc-shaped deflection piece 1 in principle may be mountable on the fastening portion 3 of the assembly carrier A without any tool and be positively fixable thereto, as this is illustrated in detail with reference to FIGS. 2, 3A and 3B.

The deflection piece 1 at each of its ends forms form-fit elements in the form of fixing pins or webs 13A, 13B, 14A, 14B. These form-fit elements 13A, 13B, 14A, 14B may be inserted into form-fit regions on the assembly carrier A and immerse therein. In the present case, form-fit regions in the form of fixation openings 4A, 4B therefor are formed in the carrier surface TF on both sides of the fastening portion 3. Into these fixation openings 4A, 4B (or a comparable, for example pocket-shaped cutout) one fixing web 14A, 14B each is inserted for fixing the deflection piece 1 on the assembly carrier A.

For the further fixation and in particular anti-rotation protection of the deflection piece 1 on the fastening portion 3, the deflection piece 1 furthermore centrally includes at least one further form-fit element in the form of a radially inwardly protruding central web 12. In the mounted condition of the deflection piece 1, this central web 12 located between the end-side form-fit elements 13A, 14A and 13B, 14B is inserted into a form-fit region in the form of a groove 32 of the fastening portion 3. The groove 32 extends transversely to the cable guide plane in an abutment surface 30 of the fastening portion 3, on which the arc-shaped deflection piece 1 rests against the fastening portion 3 with a radially inward inner side, when the deflection piece 1 is properly fixed. A radius R for the circular arc-shaped contour of the deflection piece 1 hence is identical with a radius for the convex, circular arc-shaped bulge at the upper end of the fastening portion 3.

For additionally securing the deflection piece 1 mounted on the fastening portion 3, the fastening portion 3 forms a plurality of (at least two) holding tabs 31*a* and 31*b* protruding parallel to the cable guide plane. These holding tabs 31*a* and 31*b* engage over an edge of the mounted deflection piece 1 and hence counteract a displacement of the deflection piece 1 transversely to the cable guide plane in the spatial direction −y. The deflection piece 1 attached to the fastening portion 3 and thereby to the assembly carrier A hence is positively and non-rotatably held on the assembly carrier A.

The deflection piece 1 furthermore is constructed axially symmetrically so that to form the deflection element U1 (or U2) it may also be mounted on the assembly carrier A rotated by 180°. At the respective end of the deflection piece 1 and its guide channel 10 two fixing webs 13A/14A and 13B/14B each are located, which protrude in opposite directions. Furthermore, an additional securing tab 11C or 11D faces each securing tab 11A or 11B, which in the case of an attachment of the deflection piece 1 rotated by 180° ensures the support of the Bowden cable portion guided in the guide channel 10 transversely to the direction of longitudinal extension and transversely to the cable guide plane.

Figure 4:
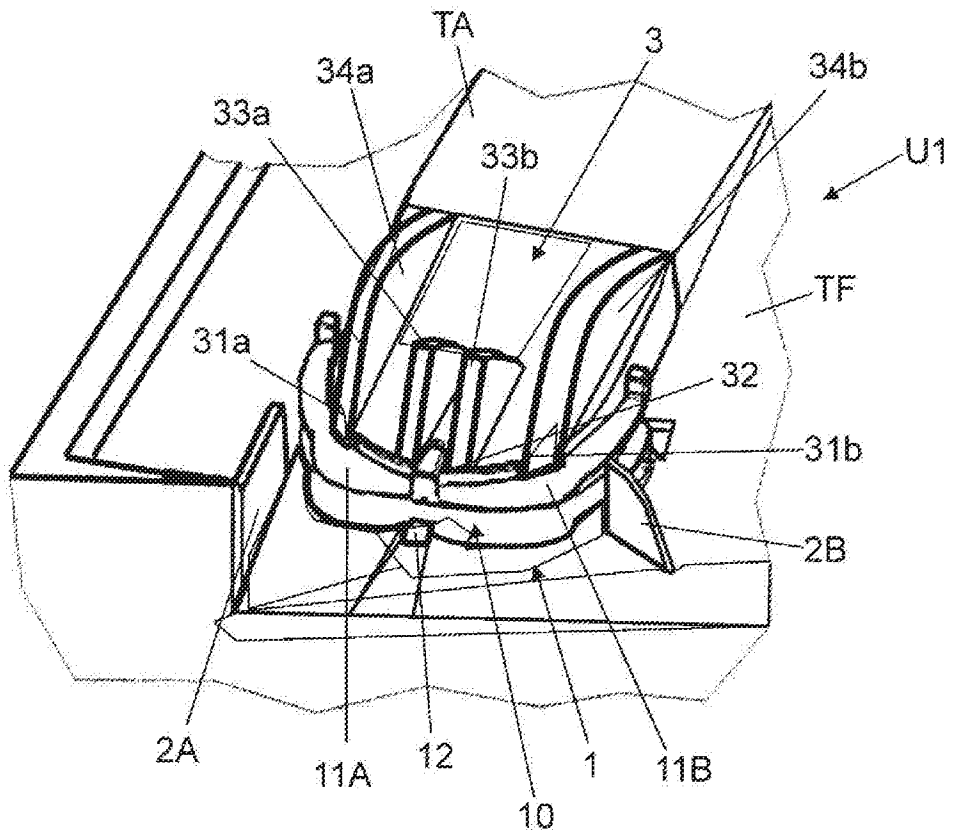
FIG. 4 shows another design variant of a window lifter assembly according to one or more embodiments, without the traction means deflected on the deflection piece.

In the development shown in FIG. 4, the deflection piece 1 is constructed identically to the design variant of FIGS. 1A to 3B. On the fastening portion 3 of the assembly carrier A, however, additional guide ribs 33*a*, 33*b* and 34*a*, 34*b* are formed in pairs. The deflection piece 1 analogous to a deflection piece of DE 10 2005 041 636 A1 may also be mountable on the assembly carrier A with a traction means Z inserted therein, wherein the deflection piece 1 initially is positioned in a mounting position on the assembly carrier A and then is pivoted (about a pivot axis extending parallel to the x-direction) into the functional position shown in FIGS. 1A, 1B and 4 ~manually or by means of a tool, for example a tensioning lever. For guiding the deflection piece 1 during this pivoting movement, the (outer) convexly curved guide ribs 34*a* and 34*b* of the fastening portion 3 of FIG. 4 may be used. The pair of (central) guide ribs 33*a* and 33*b* provided between these outer guide ribs 34*a* and 34*b* in turn may serve the guidance of the central web 12 of the deflection piece 1. The inner, central guide ribs 33*a* and 33*b* form a guiding gap between themselves, into which the central web 12 of the deflection piece 1 may immerse and be guided along the central guide ribs 33*a* and 33*b* up to the groove 32 on the fastening portion 3.

Figure 5:
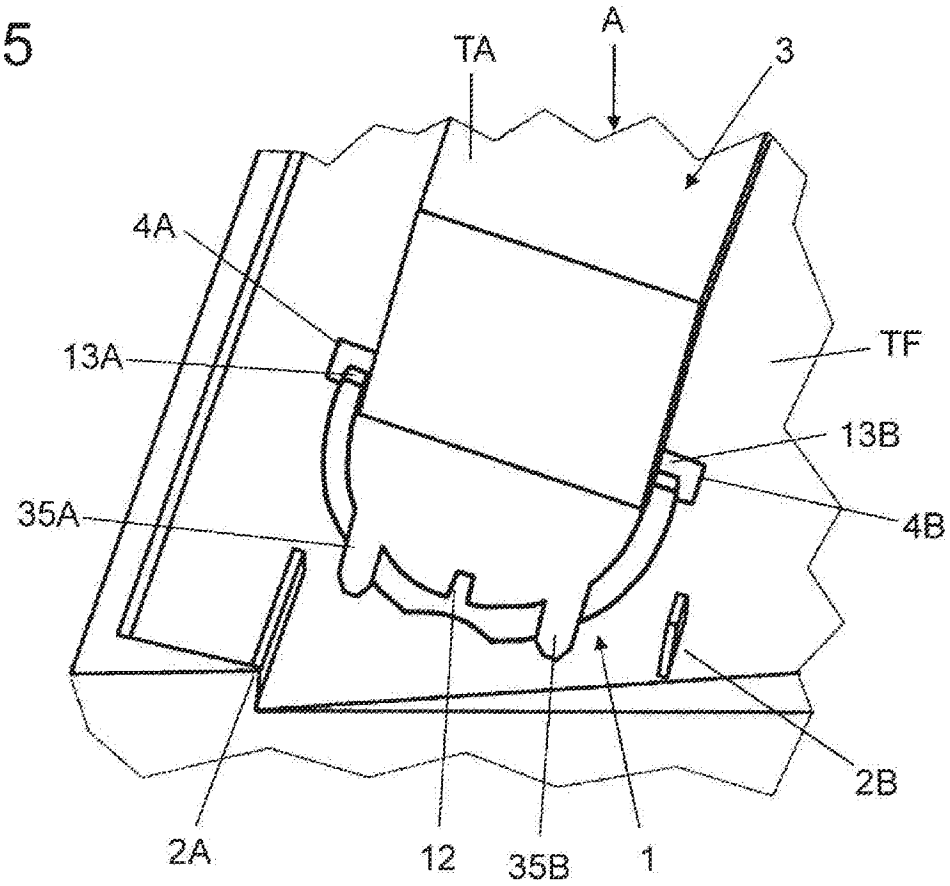
FIG. 5 shows another design variant of a window lifter assembly according to one or more embodiments, with securing elements and securing portions formed on the carrier.

In the variant of FIG. 5, in contrast to the design variants discussed above, securing tabs 35A and 35B protruding from the edge of the guide channel 10 parallel to the xz-plane are not provided on the deflection piece 1, but are formed by the assembly carrier A on the fastening portion 3 itself. When the deflection piece 1 is properly fixed to the fastening portion 3, the securing portions 35A and 35B of the assembly carrier A protrude from an edge of the guide channel 10 formed by the deflection piece 1 and in conjunction with the carrier-side securing webs 2A and 2B hence prevent the removal of the Bowden cable Z from the guide channel 10 also in the presence of a cable slack.

The securing portions 35A and 35B formed on the assembly carrier A in the design variant of FIG. 5 here are formed to protrude in a web-like manner, but are not fixed at the illustrated shape. Due to the integration of the securing portions 35A and 35B on the assembly carrier A and hence on the carrier of the window lifter assembly itself, the formation of the securing portions 35A and 35B from the material of the assembly carrier A, which is less expensive than the material of the deflection piece 1, is possible.

Figure 6:
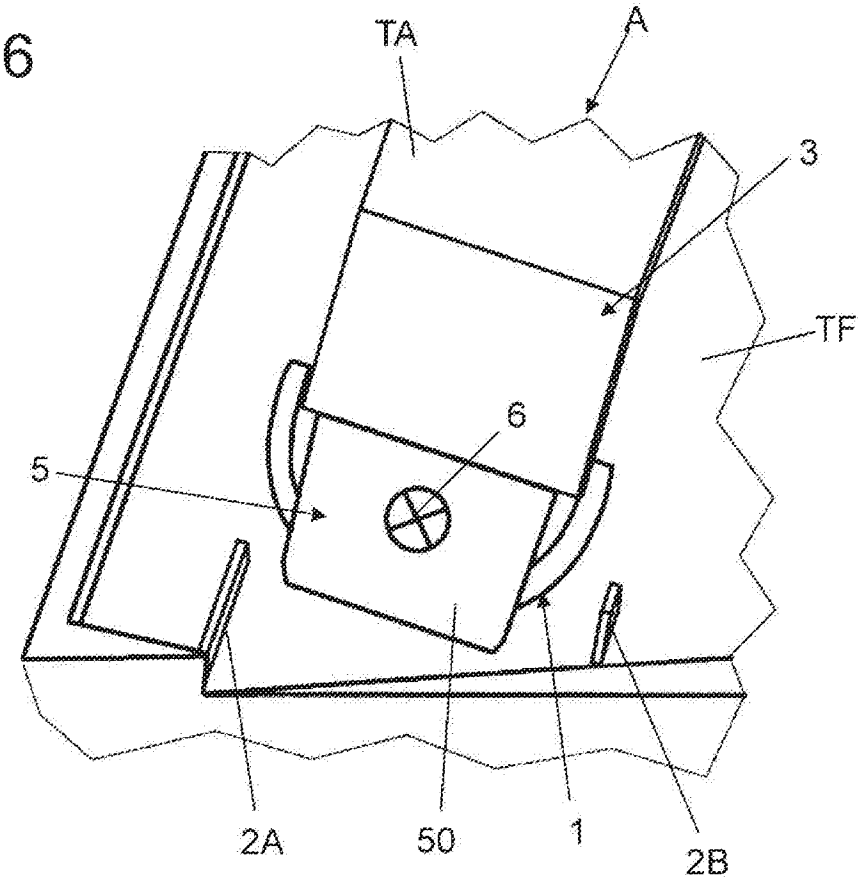
FIG. 6 shows another design variant of a window lifter assembly according to one or more embodiments, with securing elements formed on the carrier and securing portions formed by an additional securing component.

In the design variant of FIG. 6 a securing portion 50 for bordering the guide channel 10 at its edge and the related support of possible transverse forces in the −y direction is provided by a separate securing component 5. Via a fastening element 6, for example a screw, a rivet or a bolt, this securing component 5 is fixed to the assembly carrier A in the region of the fastening portion 3 as a separate component. Other than shown in FIG. 6, the securing component 5 may also be clipped, hot-caulked or ultrasonically welded to the assembly carrier A.

In the properly mounted condition, the securing component 5 with its securing portion 50 protrudes (downwards) from the guide channel 10 in the −z direction and is parallel to the xz-plane. The securing portion 50 thus counteracts a displacement of the Bowden cable portion present in the guide channel 10 due to transverse forces acting thereon in the −y direction.

In addition, the securing component 5 may serve the fixation of the deflection piece 1 mounted on the fastening portion 3. Since at least a part of the deflection piece 1, in particular a central part with the central web 12, is received between the carrier surface TF and the securing component 5, the securing component 5 is able to positively and/or non-positively secure the position of the deflection piece 1 arranged on the assembly carrier A. By providing the additional securing component 5, for example for securing the deflection piece 1 on the fastening portion 3, the formation of retaining lugs 31*a* and 31*b* on the fastening portion 3 corresponding to the design variants of FIGS. 1A to 3B and 4 is avoided.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

LIST OF REFERENCE NUMERALS

1 deflection piece
10 guide channel
11A-11D securing tab (securing portion)
12 central web (form-fit element)
13A, 13B fixing web (form-fit element)
14A, 14B fixing web (form-fit element)
2A, 2B securing web (securing element)
3 fastening portion
30 abutment surface
31*a*, 31*b* retaining tab
32 groove (form-fit region)
33*a*, 33*b* central guide rib
34*a*, 34*b* outer guide rib
35A, 35B securing tab (securing portion)
4A, 4B fixing opening (form-fit region)
5 securing component
50 securing portion
6 fastening element
A assembly carrier (carrier)
a1, a2 distance
b1, b2 deflection
F guide rail
$F_S$ cable force
I door inner skin
K door component
M driver
O window opening
R window frame
S window pane s1, s2 gap
T cable drum
TA carrier portion
TF carrier surface
U1, U2 deflection element
Z, Z' Bowden cable (traction means)
ZA1, ZA2 Bowden cable portion (traction means portion)
ZV adjustment portion

The invention claimed is:

1. A window lifter assembly configured to adjust a window pane comprising:
a carrier, including a first securing element and a second securing element;
a flexible traction means configured to transmit an adjusting force to adjust the window pane; and
a deflection piece arranged on the carrier in non-rotatable manner including a guide channel configured to deflect the traction means within a guide plane,
wherein the first and second securing elements and at least one securing portion are configured to hold the traction means in the guide channel, wherein the first securing element and the second securing element are spaced apart from each other and are arranged to face different regions of the guide channel,
wherein the at least one securing portion protrudes from an edge of the guide channel in a spatial direction, substantially parallel to the guide plane,
wherein the first and second securing elements and the at least one securing portion are formed and arranged relative to each other such that when traction means portions of the traction means are displaced out of the guide channel to abut against one of the first and second securing elements, the at least one securing portion blocks the traction means against a displacement that is transverse to the guide plane out of the guide channel,
wherein the guide channel has a varying depth, wherein a first portion of the guide channel has a first depth, wherein the first depth is less than a first mean diameter of a first portion of the traction means disposed therein, wherein a second portion of the guide channel, bordered by the at least one securing portion, has a second depth, and wherein the second depth is greater than a mean diameter of a second portion of the traction means disposed therein.

2. The window lifter assembly of claim 1, wherein the first and second securing elements and the at least one securing portion are arranged with respect to each other and to the traction means such that the first and second securing elements and the at least one securing portion prevent the traction means from being displaced out of the guide channel in a direction that is parallel to the guide plane and a direction that is transverse to the guide plane.

3. The window lifter assembly of claim 1, wherein a gap is formed between each one of the first and second securing elements and the deflection piece, wherein when the window lifter operates, the traction means in a tensioned state, wherein when the traction means is in a relaxed state, different from the tensioned state, the traction means extends through the gap, wherein a traction means portion of the traction means is held in the gap by the first securing element or the second securing element, and the traction means portion is collectively held in the guide channel by the first securing element or the securing element and the at least one securing portion.

4. The window lifter assembly of claim 3, wherein the gap has a width, wherein the width ranges between a mean diameter of the traction means and three times the mean diameter of the traction means.

5. The window lifter assembly of claim 3, wherein a width of the gap and an average diameter of the traction means are collectively configured to permit insertion of the traction means in the gap when the traction means is in the relaxed state and removal of traction means in a direction transverse to the guide plane.

6. The window lifter assembly of claim 1, wherein the guide channel has a first length, wherein the first portion of the guide channel has a second length that is at least half of first length.

7. The window lifter assembly of claim 1, wherein the guide channel has an arc-shaped extension.

8. The window lifter assembly of claim 1, wherein the guide channel extends in a first direction, and wherein the first securing element and the second securing element are each offset from the at least one securing portion, with respect to the first direction.

9. The window lifter assembly of claim 1, wherein the at least one securing portion is disposed on the deflection piece.

10. The window lifter assembly of claim 9, wherein the at least one securing portion includes a first securing portion and a second securing portion each disposed on the deflection piece, wherein the first securing portion and the second securing portion are spaced apart from each other and border different regions of the guide channel.

11. The window lifter assembly of claim 1, wherein the deflection piece is formed as a separate component and fixed to the carrier.

12. The window lifter assembly of claim 11, wherein the deflection piece is positively connected to a number of form-fit regions formed by the carrier.

13. The window lifter assembly of claim 12, wherein at least one form-fit region of the number of form-fit regions includes a groove, an opening, or a depression.

14. The window lifter assembly of claim 12, wherein the deflection piece includes at least three form-fit elements configured to positively connect the deflection piece to the carrier, wherein at least two end-side form-fit elements of the least three form-fit elements are each disposed in a region of an end of the guide channel, and wherein at least one other form-fit element of the least three form-fit elements are disposed between the end-side form-fit elements and along the guide channel.

15. The window lifter assembly of claim 11, wherein the deflection piece is symmetrical with respect to an axis extending parallel to the guide plane, and configured to be mounted on the carrier in a first orientation and a second orientation, wherein when the deflection piece is in the second orientation the deflection piece is rotated about the axis by 180° from the first orientation.

16. The window lifter assembly of claim 11, wherein the deflection piece is at least partly embedded in the carrier.

17. The window lifter assembly of claim 1, wherein the deflection piece is formed of a polyaryl ether plastic, including PEEK.

18. A window lifter for the adjustment of a window pane in a vehicle, comprising the window lifter assembly of claim 1.

19. A door module for a vehicle door, comprising the window lifter assembly of claim 1.

* * * * *